United States Patent [19]

Seeger et al.

[11] 4,253,443

[45] Mar. 3, 1981

[54] INTERNAL COMBUSTION ENGINE IGNITION SYSTEM

[75] Inventors: Karl Seeger, Ditzingen; Walter Ruf, Schwieberdingen; Gerhard Söhner, Remshalden; Werner Jundt, Ludwigsburg, all of Fed. Rep. of Germany

[73] Assignee: Robert Bosch GmbH, Stuttgart, Fed. Rep. of Germany

[21] Appl. No.: 109,625

[22] Filed: Jan. 4, 1980

[30] Foreign Application Priority Data

Jan. 8, 1979 [DE] Fed. Rep. of Germany ..... 2900480

[51] Int. Cl.[3] ..... F02P 1/00

[52] U.S. Cl. ..... 123/609; 123/611

[58] Field of Search ..... 123/117 D, 148 E

[56] References Cited

U.S. PATENT DOCUMENTS

| | | | |
|---|---|---|---|
| 4,009,378 | 2/1977 | Sakamoto | 123/117 D |
| 4,121,556 | 10/1978 | Bigliani | 123/117 D |
| 4,133,323 | 1/1979 | Adler | 123/117 R |

FOREIGN PATENT DOCUMENTS

| | | | |
|---|---|---|---|
| 2824981 | 12/1979 | Fed. Rep. of Germany | 123/148 |

*Primary Examiner*—Ronald B. Cox

*Attorney, Agent, or Firm*—Frishauf, Holtz, Goodman & Woodward

[57] ABSTRACT

To permit use of shaft position transducers which provide needle pulses at predetermined angular positions of the crankshaft of an engine, such as Wiegand-type, and still enable generation of a counted dwell time even under transient conditions, or under low-speed conditions, the output from the Wiegand transducer is connected to a logic circuit which, under normal operating conditions, by use of a counter counts a predetermined time interval after opening of a switch in series with the ignition coil to determine the dwell period or initiation of current flow for a subsequent ignition event by resetting the counter with a reverse polarity subsequent pulse, thereby passing, upon reset, a predetermined count state which, similar to the normal counting of the count state, initiates closing of the switch. Thus, even though the normal counting time has not yet been reached, the reset operation of the counter will trigger closing of the switch and hence sufficient current flow through the ignition coil to store the appropriate electromagnetic energy therein for a reliable spark at the spark plug.

8 Claims, 2 Drawing Figures

INTERNAL COMBUSTION ENGINE IGNITION SYSTEM

Figure 1:
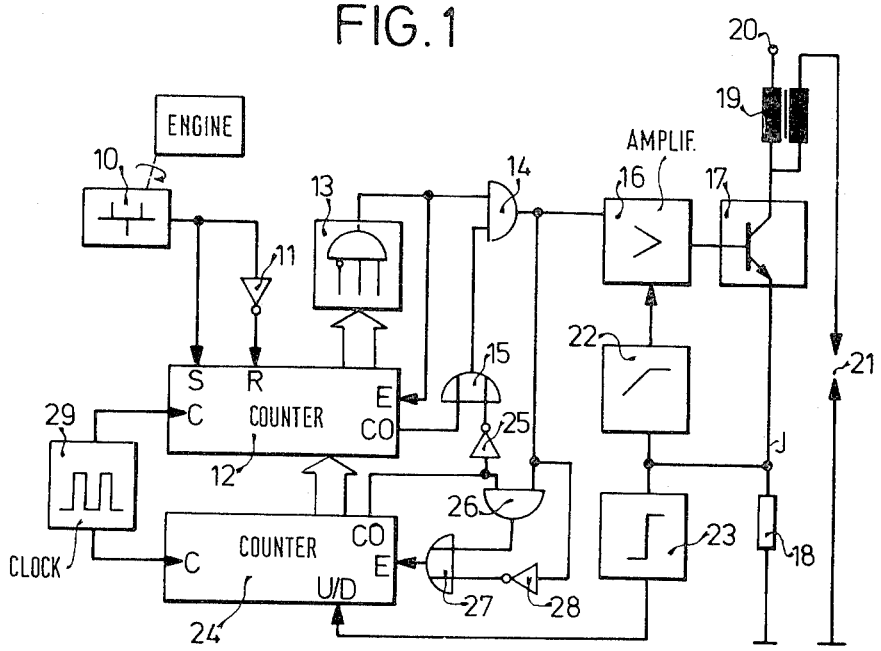

The present invention relates to the ignition system for an internal combustion engine, and more particularly to a semiconductor controlled ignition system in which an inductive sensor provides control signals which are of needle type, such as signals derived from a Wiegand transducer.

BACKGROUND AND PRIOR ART

Wiegand wire and similar transducers have been described in the automotive electronic literature, see for example "IEEE TRANSACTIONS ON VEHICULAR TECHNOLOGY", Vol. VT-26, No. 2, May 1977, as well as German Patent Disclosure Document DE-OS No. 26 54 775. The Wiegand effect itself has been described in "Electronics" of July 10, 1975, page 100 et seq. This effect is based on sudden reversal of polarization of the Wiegand wire upon change of a magnetic field; a coil which is in inductive coupling with the Wiegand wire then provides a sharp peaked needle induction pulse. This needle-shaped pulse permits exact determination of a switching instant, that is, correlation of a specific shaft position, for example the crankshaft position of an internal combustion engine with respect to the generation of the pulse. It does not provide an extended pulse output, however, which may be realized from example from a Hall transducer or an induction coil transducer, and which can provide not only a characteristic determinative of the ignition instant but also a characteristic which determines the closing of the ignition switch, that is, the dwell time of the ignition system. If a Wiegand wire is used, it is necessary to provide for electronic simulation of this dwell time period.

It has already been proposed to operate with two complementary impulses of a Wiegand transducer and to control a flip-flop therewith—see German Disclosure Document DE-OS No. 2 731 373—and to obtain an output signal from the flip-flop (FF) which is representative of the closing time, that is, the angular travel of the shaft during which the ignition controlling semiconductor should be closed, that is, the dwell angle. FFs are not well suited for use in ignition systems since they are sensitive to noise or stray pulses.

It has also been proposed to start a counter from a short pulse, for example derived from a Wiegand transducer, the counter then determining the closing or dwell time—see German Disclosure Document DE-OS No. 28 24 981. Two counting cycles in separate counters are needed in order to retain a predetermined, preferably fixed, closing time even under dynamic changes of engine operation. When a single counter is used, the danger may occur that ignition sparks will miss during dynamic changes, since the fixed closing time determination, as counted by the counter, could occur possibly before or even after the actually determined ignition time instant.

THE INVENTION

It is an object to provide an ignition system permitting use of a pulse-type transducer, such as a Wiegand effect transducer in combination with circuitry which is simple and reliable and which uses a minimum of components.

Briefly, the Wiegand transducer is arranged to provide a sequence of pulses; a first pulse from the transducer is applied to a first counter which causes the switch in series with the ignition coil to open and, additionally, initiate a counting cycle. An ignition event, thus, has been commanded while, additionally, the next counting cycle has been likewise controlled; a logic circuit is provided connected to the pulse generator and to the counter and also controlling the switch to close the switch if the counter has reached a predetermined count state or if a subsequent pulse is applied by the pulse generator even if the counter has not yet reached the second predetermined count state. Thus, a minimum closing or dwell time is ensured even though the counter may not have counted to its normal terminal period which would determine the interval between the opening of the switch and the subsequent reclosing, so that the reclosing or dwell time will always be a certain time period sufficient to build up enough electromagnetic energy in the coil to cause a good spark without, however, requiring more current flow through the coil than necessary, that is, without maintaining the coil in saturated condition for an unnecessary or excessive period of time.

The system has the advantage that, under ordinary condition, the closing instant of the switch in series with the ignition coil is determined by the counting process in a counter; a certain minimum dwell time, however, is ensured by resetting the counter by a second pulse if the count termination of the counter has not yet been reached. The counting time, then, determines the opening period of the switch which, of course, is speed-dependent if the count number to be counted likewise is speed-dependent. Count numbers and counter states are much more reliable with respect to stray and noise pulses than bistable stages.

In accordance with a feature of the invention which is particularly desirable, change-over to a fixed duty cycle operation of the switch in series with the ignition coil under low speed condition is readily possible.

Figure 2:
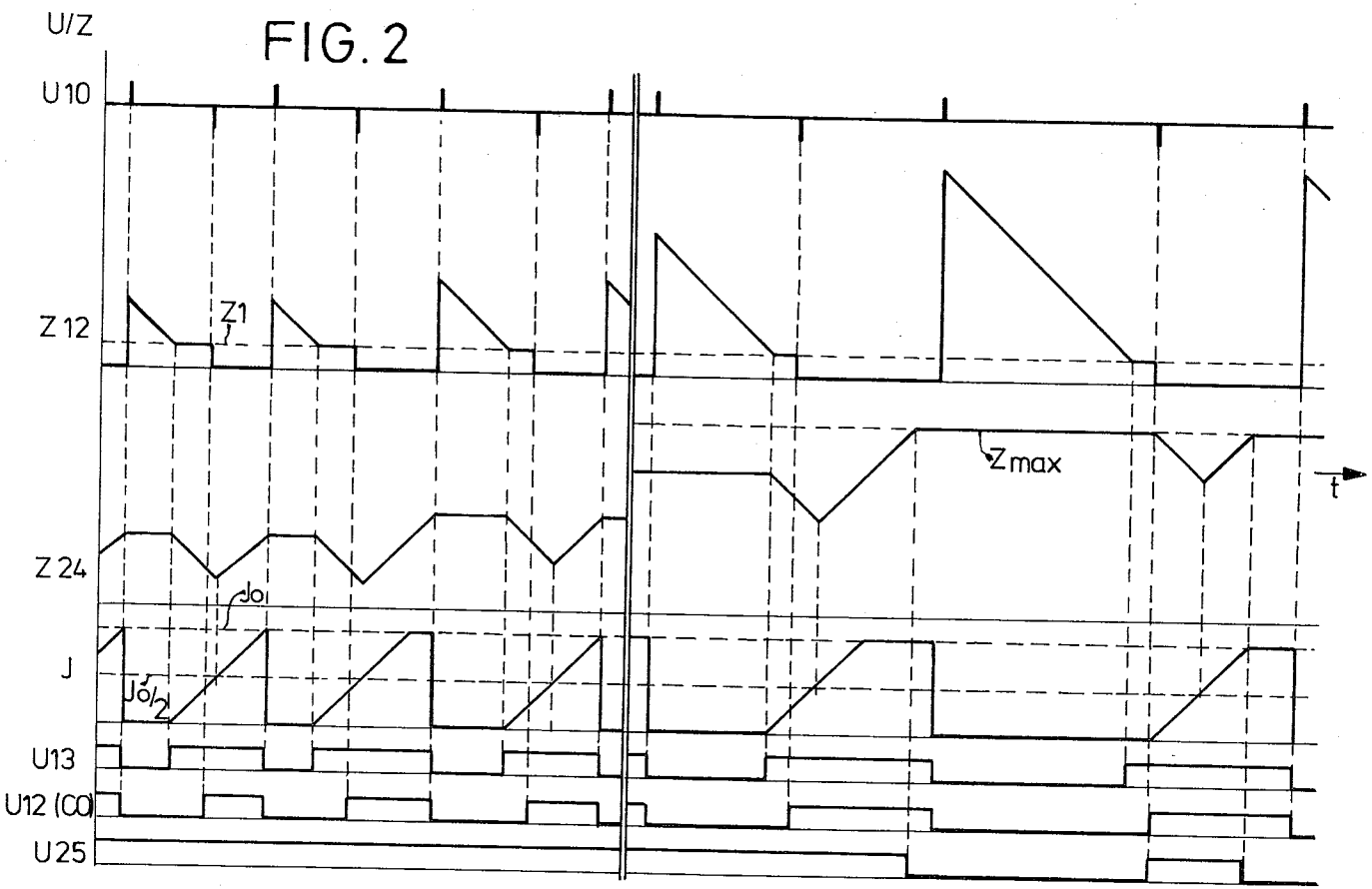

DRAWINGS:

FIG. 1 is a highly schematic diagram of the system in accordance with the invention; and FIG. 2 is a series of current and voltage graphs used in illustrating the operation of the system of the invention.

An internal combustion engine E of the Otto type has a Wiegand wire transducer 10 coupled to a rotating shaft, for example the crankshaft thereof. Any other type of transducer may be used which provides similar needle pulses, as will be discussed in connection with FIG. 2. The pulse output from the transducer 10 is applied to the set input S of a first counter 12 and, likewise, through an inverter 11 to the reset terminal of the counter 12. The construction and operation of the Wiegand transducer is known and part of the State of the Art, as exemplified for example in the references given above. The count outputs from counter 12 are connected to a decoding device 13 which recognizes when the counter reaches a certain count state, for example if the counter 12 counts down, when a certain number is passed. The output from the decoder 13 is applied to one input of an AND-gate 14. The decoder device may either be a logic gate assembly, having inputs which are respectively negative or non-negative in dependence on the number to be sensed in the counter; or a commerical decoding device may be used such as the element CD 4556 sold by RCA. The carry-over output CO of the counter 12 is connected to an OR-gate 15, the output of which is connected to AND-gate 14. The output of the decoding device 13 is further connected to the enable input E of the counter 12.

The output of the AND-gate 14 is connected over an amplifier 16 with the base of an output transistor 17 which is shown schematically but may, actually, be a Darlington stage. Its emitter is connected through a current measuring resistor 18 to a reference or chassis terminal; its collector is connected through the primary of an ignition coil 19 to a source of supply 20, the other terminal of which is also connected to the reference terminal. The secondary of ignition coil 19 is connected to at least one spark plug or spark gap 21; of course, a distributor can be interposed for multi-cylinder engines.

The voltage sensed on the current measuring resistor 18 is connected to a current limiting device 22 which, in turn, controls the amplifier 16. A typical current limiting device 22 is described in German Disclosure Document DE-OS No. 24 48 675 and, respectively, in U.S. Pat. No. 3,587,551. The voltage tapped off current measuring resistor 18 additionally is applied to a threshold stage 23, the output of which is connected to a count direction input U/D (up/down) of a second counter 24. The carry-out or overflow output CO of the second counter 24 is connected to an inverter 25 and therethrough to the second input of OR-gate 15, and additionally to one input of an AND-gate 26, the output of which is connected through an OR-gate 27 with the enable input E of the second counter 24. The output of the AND-gate 14 is connected to a further input of the AND-gate 26 and, through an inverter 28, to a further input of the OR-gate 27.

A clock generator 29 provides a clock frequency which is applied to the two clock inputs C of the counters 12, 24. The count outputs of the counter 24 are connected to the count inputs of the counter 12.

Operation, with reference to the diagrams of FIG. 2: In FIG. 2, the left side of the diagram illustrates the conditions at higher operating speeds; the right side shows the conditions at low speed, and after the speed recognition stage has responded.

Considering, first, the high speed conditon: A positive pulse of the Wiegand transducer 10 results in the counter 12—which is connected as a down-counter—being set with the numerical value which previously appeared in the counter 24, and then to start counting downwardly. When the numerical value Z1 (FIG. 2) of the counter state, shown at the graph Z12, is reached, the decoder 13 will respond and provide an output signal as shown by the graph U13. This signal will: (a) lock the counter 12 against further counting, and (b) enable the AND-gate 14 and hence, through amplifier 16, cause transistor 17 to become conductive. The inverter 25 likewise will have a 1-signal thereon. Current J (FIG. 2) will start to flow in the primary of the ignition coil 19. Since this 1-signal likewise cancels blocking of the second counter 24 through the inverter 28, counter 24 starts to count down (graph Z24). When the primary current J has reached about half of a base current Jo, at which point the current limiting sensing element 21 begins to become effective, the threshold stage 23 also will respond and will change the counting direction of the counter 24 by change of signal at the U/D input of the counter 24. The subsequent positive pulse from the transducer 10 causes renewed setting of the counter 12, release of its blocking, and blocking of the counter 24 over the inverter 28.

The first two counting cycles illustrate the case in which the speed remains constant, that is, after each down/up count cycle of the counter 24, the same counter state will be reached. The third count cycle illustrates the situation in which the speed becomes slower so that the counter 24 will reach a higher counter state. This higher counter state is transferred to the counter 12; thus, due to the longer counting time, current will begin to flow relatively later. To determine such a speed-dependent count state, it is possible to use a variety of known systems which can be employed instead of those disclosed herein, and reference is made for example to the following published documents: German Disclosure Documents DE-OS Nos. 27 01 968; 27 46 885; 28 50 113; 28 50 115.

Resetting of the counter 12 with a negative pulse which occurs between two subsequent positive pulses U10 is not significant for the beginning or termination of the closing time under the illustrated operating conditions. If, however, for example due to rapid acceleration, the negative pulse should occur before the count state Z1 in counter 12 has been reached, then the closing time will be triggered by this negative pulse since, due to the reset of the counter 12, the decoding value of the decoding device 13 has been passed at a lower level. This ensures reliable closing of the semiconductor switch 17 at high acceleration rates or, possibly, due to counting errors or stray pulses. The negative pulse, of course, is applied to the counter 12 through the inverter 11, connected to the reset terminal R, which enters into the counter a value less than that of the decoding value determined by the decoding device 13.

The diagram at the right half illustrates the condition at low speeds which is determined by the counter 24 reaching its highest counter state Zmax upon upcount. Upon reaching the highest counter state Zmax, counter 24 provides for an overflow signal at the overflow output CO. This overflow signal, during the intervals or pauses of the counter 24, is constantly applied by the inverter 25 (graph U25) as a O-signal and thus causes the closing time to occur not when the counter Z1 of the counter 12 is reached, but rather when this counter 12 is reset by a negative transducer signal U10. Without this system, the delay of the closing time would become excessive although actually it should be decreased. In order to prevent an increase of the closing time—excessive dwell time—the closing time is controlled at a certain speed, determined by the highest count state of the counter 24, to be of a fixed dwell angle, that is, is constant with respect to dwell angle depending on the distance—with respect to angle of rotation of the shaft—between a negative and positive pulse U10 (FIG. 2). The count cycle in counter 24 thus does not start upon the count state Z1 by the counter 12 being reached, but rather only with a negative pulse U10 from the transducer 10.

The AND-gate 26 and the OR-gate 27 connected thereto are used to block the counter 24 when its highest count state Zmax is reached.

The solution in which the counter 12 is connected as an upcounter is analogous to the system described herein; the output value of the counter 24 then controls the decoding value of the decoding device 13 which, in that case, can be constructed as a digital comparator. In such a system, also, a speed-dependent count value is being counted.

Various changes and modifications may be made within the scope of the inventive concept.

We claim:

1. Internal combustion engine ignition system having an ignition coil (19);

a controlled semiconductor switch (17) serially connected with the primary of the ignition coil;

at least one spark gap (21) connected to the secondary of the ignition coil;

a pulse generator (10) coupled to the engine (E) and driven thereby and providing needle pulses having a predetermined time relation to the angular position of the crankshaft of the engine;

and connection means including at least one counter (12) and switch closing and switch opening control circuit means controlled by the count state of the counter and connecting said pulse generator (10) and the switch (17) to control the switch to close at a predetermined time and permit current flow through the coil and then to open, and cause generation of an ignition event, wherein, in accordance with the invention, a first pulse from the pulse generator means is applied (a) to said counter means to cause the semiconductor switch (17) to open and (b) to initiate a count cycle of the counter;

and a logic circuit (11, 13, 14) is provided, connected to both said pulse generator and the counter (12) and controlling the switch (17) to close if either:

(c) the counter has reached a predetermined count state or (d) a subsequent pulse is applied by the pulse generator even if the counter has not yet reached said predetermined count state.

2. System according to claim 1, wherein said pulse generator (10) comprises a Wiegand-type pulse generator.

3. System according to claim 1, wherein the subsequent pulse triggering the event (d) is a pulse of a polarity which is reversed with respect to the next preceding and further subsequent pulse.

4. System according to claim 1, wherein the logic circuit (14) comprises an AND-gate and a decoding device (13) connected to the counter to determine a decoding number from the counter and which is connected to the AND-gate to provide an input thereto;

means (15) connecting the overflow output of the counter (12) to another input of the AND-gate;

and means (11) connected to a reset input (R) of the counter (12) and to receive a subsequent pulse from the pulse generator (10) and effecting resetting of the counter, and hence passing of the number set into the decoding device (13) to enable the AND-gate if (e) the counter has reached the number set in the decoding device in the normal count cycle or (f) the counter passes the number set into the decoding device upon resetting.

5. System according to claim 1, further including a second counter (24) to determine a speed-dependent count value;

means (18, 23) serially connected with the ignition coil and determining a predetermined current flow through the ignition coil, and controlling counting of the second counter (24) from the instant of closing of said semiconductor switch (17) until said predetermined current value is reached, in one direction, and then controlling the second counter (24) to count in the reverse direction.

6. System according to claim 1, further including a low-speed sensing means (24) connected to sense when the engine speed has dropped below a predetermined value;

and means connected to said low-speed sensing means and to said connection means to permit determination of the closing time of said semiconductor switch (17) only under the condition (d) as set forth in claim 1.

7. System according to claim 6, wherein the low-speed sensing means comprises a counter having an overflow output (CO), the overflow output of the counter being connected to the logic circuit.

8. System according to claim 5, wherein said second counter has an overflow output;

and the overflow output is connected to the logic circuit to permit generation of the closing signal for said semiconductor switch (17) under the condition (d) as set forth in claim 1.

* * * * *